United States Patent [19]

Adams et al.

[11] Patent Number: 5,040,695

[45] Date of Patent: Aug. 20, 1991

[54] TEAR OFF HINGE

[75] Inventors: Dwight V. Adams; Donald S. Aikin, both of Roanoke Rapids, N.C.

[73] Assignee: W. R. Grace & Co.-Conn., Duncan, S.C.

[21] Appl. No.: 548,785

[22] Filed: Jul. 6, 1990

[51] Int. Cl.[5] ..... B65D 17/34

[52] U.S. Cl. ..... 220/270; 220/266; 220/334; 220/339; 206/602; 206/605

[58] Field of Search ..... 220/334, 337, 339, 270, 220/279, 280, 4.23, 4.24, 266; 206/605, 602, 617

[56] References Cited

U.S. PATENT DOCUMENTS

| | | | |
|---|---|---|---|
| 2,884,155 | 4/1959 | Hanson | 206/602 X |
| 3,288,278 | 11/1966 | Rich et al. | 206/617 X |
| 3,396,836 | 8/1968 | Cook | 206/617 X |
| 3,596,822 | 8/1971 | Holley | 220/339 X |
| 3,685,645 | 8/1972 | Kawaguchi | 206/602 X |
| 4,127,189 | 11/1978 | Shumrak et al. | 220/339 X |
| 4,273,249 | 6/1981 | Florian | 220/339 X |
| 4,454,958 | 6/1984 | Juillet et al. | 220/339 |
| 4,533,052 | 8/1985 | Fruchey et al. | 206/602 |
| 4,553,692 | 11/1985 | Padovani | 220/339 X |
| 4,848,649 | 7/1989 | Fuller et al. | 229/123.2 |

*Primary Examiner*—Stephen Marcus
*Assistant Examiner*—Stephen Cronin
*Attorney, Agent, or Firm*—John J. Toney; William D. Lee, Jr.; Mark B. Quatt

[57] ABSTRACT

A molded container includes body and cover portions and a hinge with a central thickened rib and relatively thin segments on either side of the rib. A means for initiating tear can be used to tear open the container along the hinge to provide quick access to the interior of the container.

8 Claims, 2 Drawing Sheets

TEAR OFF HINGE

BACKGROUND OF THE INVENTION

This invention relates generally to thermoplastic containers, and more particularly to a new and improved tear out hinge means for blow molded cases.

Blow molded containers are commonly used in packaging articles which require some measure of protection against shock and abuse during storage and shipping.

Often, these blow molded containers are of double wall construction to enhance the cushioning effect of the container while also providing shaped areas for the article to be carried in the container. Typically, the containers are blow molded into a cover portion, a body portion, and an integral hinge arrangement. Alternatively, the body portion and cover portion are separately molded, and a hinge may either be formed integrally on each portion, or may be separately attached to each portion to provide a hinge means for opening and closing the container after joining the body portion and cover portion.

More recently, blow molded containers which have a means for locking the container, such as those for the storage of fire arms, have become popular. Because these containers can be locked, access to the locked container requires using a key to unlock the container, or utilizing a combination in the case of the combination lock. While these features provide a secure means for keeping the fire arm or other device safely in the container, they also require time to reopen the container.

It is therefore an object of the present invention to provide a means for quickly opening a locked blow molded container.

While this invention is especially suited to quickly opening a locked blow molded case containing a fire arm, the invention can also be used to provide quick access to other blow molded articles, such as covers for fire extinguishers or other products which are preferably securely locked inside a container, and yet can require quick access in case of an emergency.

SUMMARY OF THE INVENTION

The present invention comprises a molded container comprising a body portion; a cover portion; a hinge joining the body and cover portions; and the hinge comprising a relatively thick rib along substantially the entire length of the hinge, a relatively thin segment on each side of the rib, connecting the rib to the body and cover portions respectively, and means for initiating tearing, disposed at one end of the rib.

BRIEF DESCRIPTION OF THE DRAWINGS

The invention may be further understood by reference to the drawings, in which.

DESCRIPTION OF THE PREFERRED EMBODIMENT

Figure 1:
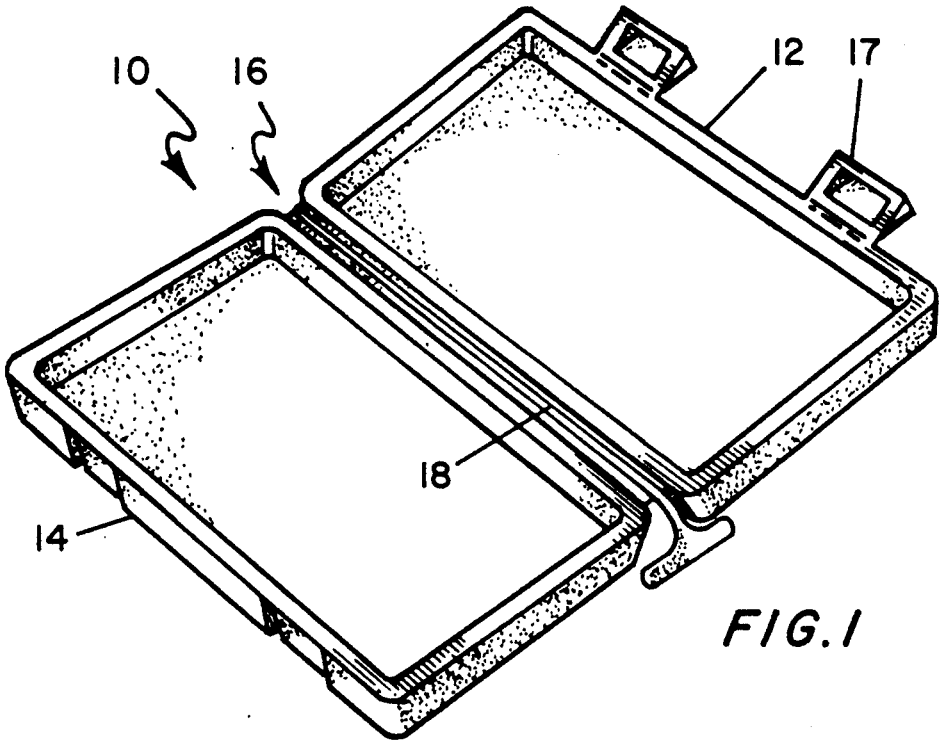
FIG. 1 shows a perspective view of a molded container in accordance with the present invention, the container being in an open position.

Referring to FIG. 1, a molded container 10 is preferably blow molded by well known means, although other molding techniques such as injection molding may also be used to produce the container of the present invention.

Container 10 includes a body portion 14 and a cover portion 12. Blow molded containers of this general arrangement are well known in the art. Suitable latching means 17, and means for accommodating a key lock or combination lock (not shown) can be included as needed in the container either as integral portions of the container, or added as a discrete component after the molding operation.

The hinge means 16 is preferably an integral hinge. Integral hinges are well known in the art, and are produced along with the body and cover portions respectively during a molding operation such as a blow molding operation.

Figure 2:
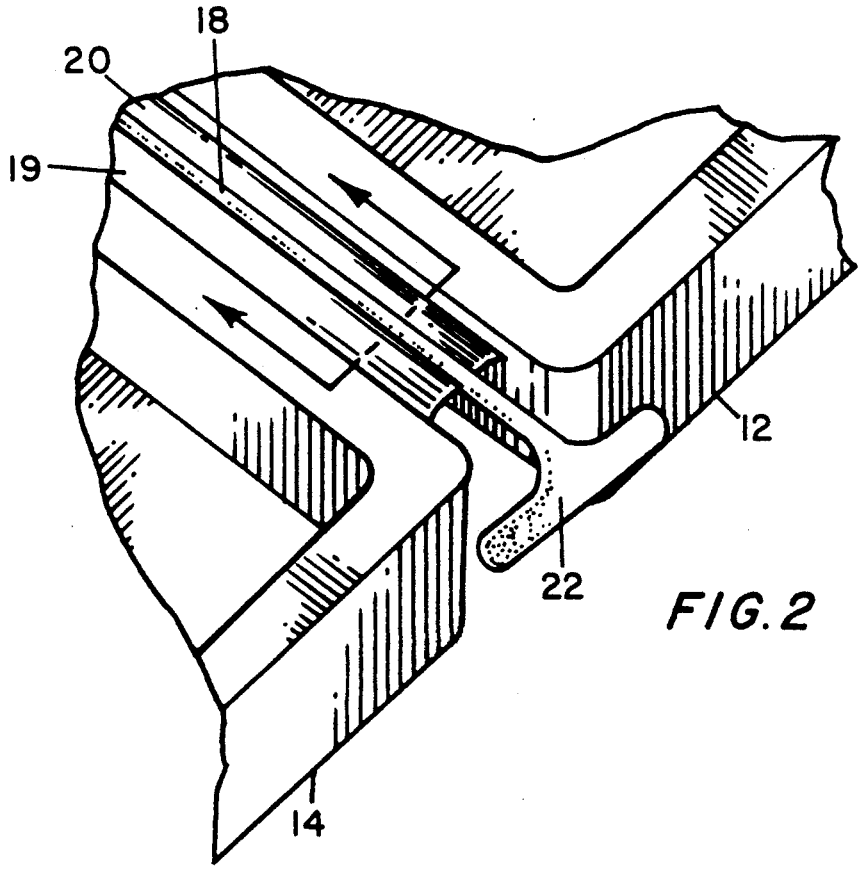
FIG. 2 shows a fragmentary enlarged perspective view of the hinge portion of the container.

A unique feature of the integral hinge 16 of the present invention is shown in more detail in FIG. 2. A central rib 18 runs along the length of the hinge, preferably equidistant from the body portion 14 and cover portion 12. On each side of the relatively thick rib 18 is a relatively thin segment 19 and 20 respectively. Segment 19 connects rib 18 to body portion 14. Segment 20 connects rib 18 to cover portion 12.

Although the rib 18 can be positioned at any point between the respective body and cover portions of the container, it is preferably disposed equidistantly from the respective portions to optimize the tear open action to be described below.

The rib 18 is preferably thicker than the adjoining relatively thin segments 19 and 20, and more preferably at least two times thicker than segments 19 or 20. Most preferably, rib 18 is at least about 3 times thicker than segments 19 or 20 to enhance the tear open mechanism.

At one end of, and integrally joined to rib 18 is a means for initiating tear 22. This means is preferably a widened portion such a T-shaped tab.

Figure 4:
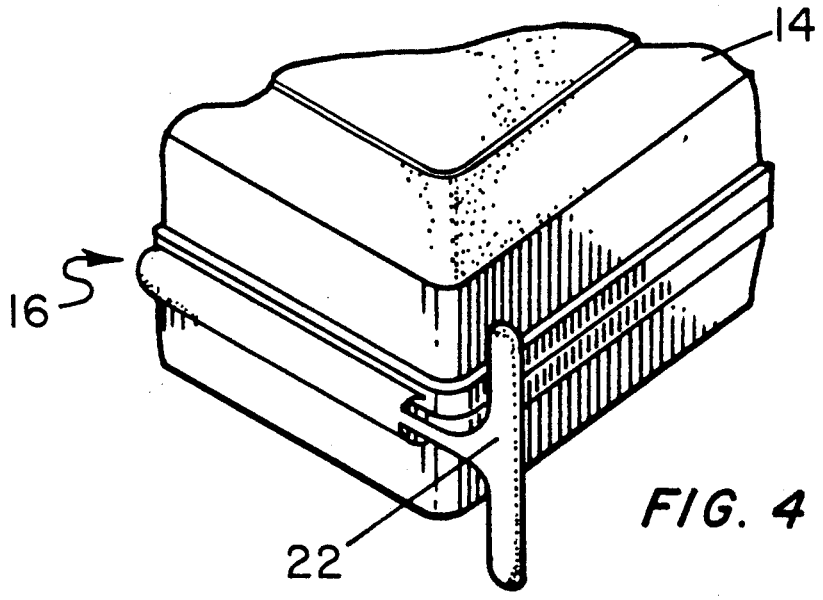
FIG. 4 shows a molded container of the present invention, the container being closed.
Figure 5:
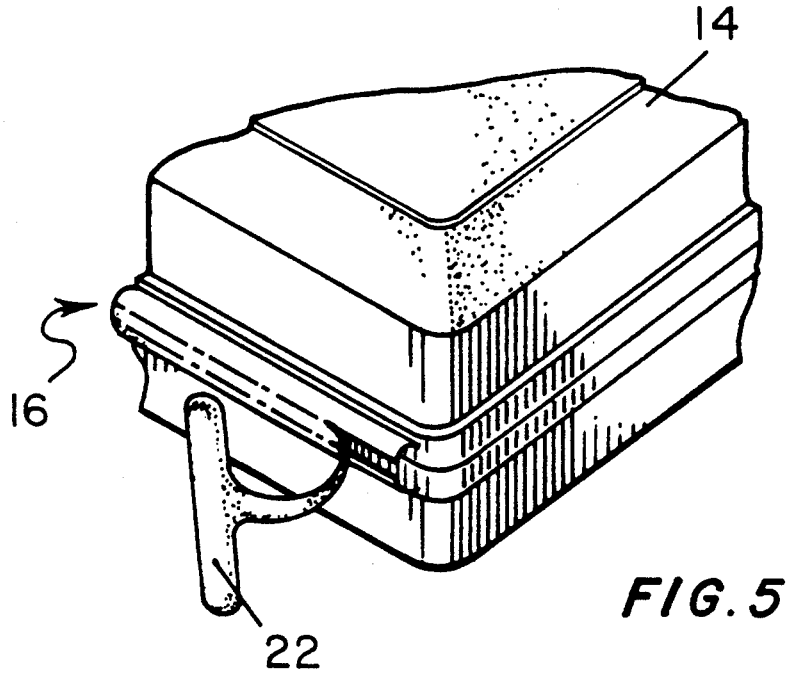
FIG. 5 shows the closed container of FIG. 4 as the hinge is being separated in accordance with the present invention.

As shown in FIGS. 4 and 5, the tab will be disposed along one end of the hinge 16 when the container is in a closed position.

The container will be typically locked, and normally would be unlocked by conventional means to provide access to the interior of the container. In an emergency situation, or when quick access to the interior of the container and its contents is desired, or in the event of an inability to open the container in the conventional manner, tab 22 can be manually pulled away from the container as shown in FIG. 5 to tear the rib 18 from the adjoining segments 19 and 20.

Figure 3:
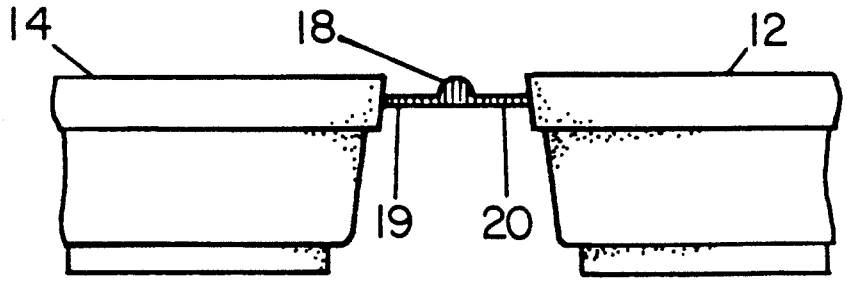
FIG. 3 shows a cross-section of the hinge section of FIG. 2.

The relationship between rib 18 and segments 19 and 20, and their relative position with respect to body portion 14 and cover portion 12, is shown in an elevational view in FIG. 3.

While the invention has been described in terms of preferred embodiments, those skilled in the art will understand that modifications may be made without departing from the scope of the invention. For example, although an integral hinge is preferred especially in blow molded containers, the hinge 16 as depicted may be a discrete hinge which is separately produced and then added to a body portion and cover portion as a discrete component.

The relative thickness of rib 18 as well as its width across the hinge area can be varied according to the types of materials used, and the desired ease or difficulty of tearing open the hinge in the manner described.

Various configurations may be used for the means 22 for initiating tear, including a simple extension of rib 20 beyond the ends of segments 19 and 20.

A means for initiating tear 22 can be included at the opposite end of the hinge as well, so that tear can be initiated from either end of the hinge.

The materials suitable for the container 10, and for the hinge 16 of the present invention can be those typically used in blow molding or injection molding operations, including various olefin polymers and copolymers, as long as these materials allow for the manual tear out mechanism described above.

What is claimed is:

1. A molded container comprising:

a) a body portion;

b) a cover portion;

c) a hinge joining the body and cover portions; and d) said hinge comprising:

i) a relatively thick rib along substantially the entire length of the hinge, ii) a relatively thin segment on each side of the rib, connecting the rib to the body and cover portions respectively, and iii) a means for initiating tearing, disposed at one end of the rib.

2. The container of claim 1 wherein the container is blow molded.

3. The container of claim 2 wherein the container is a double walled blow molded container.

4. The container of claim 1 wherein the container is injection molded.

5. The container of claim 1 wherein the rib is at least two times thicker than either of the segments.

6. The container of claim 1 wherein the rib is at least three times thicker than either of the segments.

7. The container of claim 1 wherein the means for initiating tear is an integral extension of the rib.

8. The container of claim 1 wherein the means for initiating tear is a T-shaped tab disposed at one end of the rib.

* * * * *